US009424791B2

(12) United States Patent
Jung

(10) Patent No.: US 9,424,791 B2
(45) Date of Patent: Aug. 23, 2016

(54) REFLECTIVE DISPLAY DEVICE

(75) Inventor: Myoung-hoon Jung, Seoul (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 812 days.

(21) Appl. No.: 13/613,760

(22) Filed: Sep. 13, 2012

(65) Prior Publication Data

US 2013/0176295 A1 Jul. 11, 2013

(30) Foreign Application Priority Data

Jan. 9, 2012 (KR) ..... 10-2012-0002472

(51) Int. Cl.
*G09G 5/00* (2006.01)
*G09G 3/36* (2006.01)
*G09G 3/34* (2006.01)

(52) U.S. Cl.
CPC ..... *G09G 3/3648* (2013.01); *G09G 3/344* (2013.01); *G09G 2230/00* (2013.01)

(58) Field of Classification Search
CPC ..... G09G 3/3648
USPC ..... 345/212
See application file for complete search history.

(56) References Cited

U.S. PATENT DOCUMENTS 6,989,826 B2 1/2006 Kasai
8,629,820 B2 * 1/2014 Do ..... G09G 3/3655 345/204
2008/0055292 A1 * 3/2008 Do ..... G02F 1/133707 345/204
2008/0150887 A1 * 6/2008 Kim ..... G02F 1/167 345/107
2008/0225189 A1 * 9/2008 Yang ..... G09G 3/3659 349/37
2009/0167660 A1 7/2009 Wang et al.
2009/0295693 A1 * 12/2009 Yeom ..... G09G 3/3648 345/88
2010/0001940 A1 * 1/2010 Lee ..... G09G 3/3659 345/90
2010/0039458 A1 2/2010 Nathan et al.
2012/0113083 A1 * 5/2012 Kim ..... G09G 3/3655 345/212

FOREIGN PATENT DOCUMENTS

KR 10-2010-0058140 A 6/2010

* cited by examiner

*Primary Examiner* — Jason Olson
(74) *Attorney, Agent, or Firm* — Harness, Dickey & Pierce, P.L.C.

(57) ABSTRACT

A reflective display device includes a pixel array including a plurality of pixels; a data driver connected to each of the plurality of pixels and configured to transmit a target voltage to each of the plurality of pixels; and a scan driver connected to each of the plurality of pixels and configured to transmit a switching signal for determining whether the data driver transmits the target voltage to some of the plurality of pixels, wherein each of the plurality of pixels is configured to receive the target voltage for single data information, receive the target voltage in a first time period when the target voltage transmitted to each of the plurality of pixels is between a first voltage level and a second voltage level, and receive the target voltage in a second time period when the target voltage is between the second voltage level and a third voltage level.

16 Claims, 10 Drawing Sheets

REFLECTIVE DISPLAY DEVICE

CROSS-REFERENCE TO RELATED APPLICATIONS

This application claims the benefit of Korean Patent Application No. 10-2012-0002472, filed on Jan. 9, 2012, in the Korean Intellectual Property Office, the disclosure of which is incorporated herein in its entirety by reference.

BACKGROUND

1. Field

The present disclosure relates to reflective display devices, and more particularly, to a reflective display device that includes a pixel array including a plurality of thin film transistors (TFTs).

2. Description of the Related Art

Recently, reflective displays that have high visibility and low power consumption have attracted attention as displays for portable apparatuses. In the reflective displays, a voltage for driving a display device is relatively high, and the driving voltage is increased to obtain high reflexibility. However, if a high driving voltage is applied, oxide films of thin film transistors (TFTs) may be degraded and leakage current may be generated. Thus, it is desirable to obtain a pixel circuit for reducing or preventing degradation of oxide films of TFTs and generation of leakage current even when a high driving voltage is applied.

SUMMARY

Provided are reflective display devices for reducing or preventing degradation of oxide films of thin film transistors (TFTs) and/or generation of leakage current.

Provided are pixel devices for reducing or preventing degradation of oxide films of TFTs and/or generation of leakage current.

Additional example embodiments will be set forth in part in the description which follows and, in part, will be apparent from the description, or may be learned by practice of the presented example embodiments.

According to an example embodiment, a reflective display device includes: a pixel array including a plurality of pixels; a data driver connected to each of the plurality of pixels and configured to transmit a target voltage to each of the plurality of pixels; and a scan driver connected to each of the plurality of pixels and configured to transmit a switching signal for determining whether the data driver transmits the target voltage to some of the plurality of pixels, wherein each of the plurality of pixels is configured to receive the target voltage for single data information from the data driver, receive the target voltage in a first time period when the target voltage that is transmitted to each of the plurality of pixels is between a first voltage level and a second voltage level, and receive the target voltage in a second time period when the target voltage is between the second voltage level and a third voltage level.

Each of the plurality of pixels may include a switching transistor of which a drain electrode is connected to the data driver and of which a gate electrode is connected to the scan driver, wherein, in the first time period, the switching transistor is turned on when a voltage level of the switching signal is more than a voltage level obtained by adding a threshold voltage level to the first voltage level and is turned off when the voltage level of the switching signal is the second voltage level, and, in the second time period, the switching transistor is turned on when a voltage level of the switching signal is more than a voltage level obtained by adding the threshold voltage level to the second voltage level and is turned off when the voltage level of the switching signal is the third voltage level.

Each of the plurality of pixels may further include: a storage capacitor configured to store the target voltage; and a buffer transistor connected in series between a source electrode of the switching transistor and the storage capacitor, wherein, in the first time period, a voltage that is more than the voltage level that is obtained by adding the threshold voltage level to the first voltage level is applied to a gate terminal of the buffer transistor, and, in the second time period, a voltage that is more than the voltage level that is obtained by adding the threshold voltage level to the second voltage level is applied to the gate terminal of the buffer transistor.

When the target voltage that is transmitted to each of the plurality of pixels is between the first voltage level and the second voltage level, a voltage level of the target voltage may be applied to each pixel in the first time period, and a voltage of each pixel may be maintained at the voltage level of the target voltage in the second time period.

When the target voltage that is transmitted to each of the plurality of pixels is between the second voltage level and the third voltage level, a fourth voltage level between the first voltage level and the second voltage level may be applied to each pixel in the first time period, and a voltage level of the target voltage may be applied to each pixel in the second time period.

The fourth voltage level may be an average of the first voltage level and the voltage level of the target voltage.

Each of the plurality of pixels may be previously set at a voltage level between the first voltage level and the third voltage level before the first time period.

The first voltage level may be a maximum level of the target voltage, a minimum level of the target voltage, or an average of the maximum level and the minimum level.

The data information may include contrast information.

According to another example embodiment, a reflective display device including: a pixel array including a plurality of pixels; a data driver connected to each of the plurality of pixels and configured to transmit a target voltage to each of the plurality of pixels; and a scan driver connected to each of the plurality of pixels and configured to transmit a switching signal for determining whether the data driver transmits the target voltage to some of the plurality of pixels, wherein each of the plurality of pixels is configured to receive the target voltage for single data information from the data driver and receive the target voltage in divided different time periods according to a voltage level range to which the target voltage belongs.

Each of the plurality of pixels may include a switching transistor of which a drain electrode is connected to the data driver and of which a gate electrode is connected to the scan driver, wherein the switching signal turns on or off the switching transistor, a voltage level of the switching signal, by which the switching transistor is turned on, varies depending on the divided different time periods, and a voltage level of the switching signal, by which the switching transistor is turned off, varies depending on the divided different time periods.

Each of the plurality of pixels may further include: a storage capacitor configured to store the target voltage; and a buffer transistor connected in series between a source electrode of the switching transistor and the storage capacitor, wherein the buffer transistor is turned on in all the divided different time periods and a gate voltage of the buffer transistor varies depending on each of the divided different time periods.

The data information may include contrast information.

According to another example embodiment, a pixel device for a reflective display, the pixel device including: a switching transistor of which a drain electrode is connected to a data driver, of which a gate electrode is connected to a scan driver, and configured to switch a target voltage; a storage capacitor connected to a source electrode of the switching transistor and stores the target voltage; and a display element connected in parallel to the storage capacitor and displays data corresponding to the target voltage, wherein the storage capacitor receives the target voltage for single data information from the data driver and receives the target voltage in divided different time periods according to a voltage level range to which the target voltage belongs.

In a first time period of the divided different time periods, the switching transistor may be turned on when a voltage level of a switching signal is more than a voltage level obtained by adding a threshold voltage level to a first voltage level and may be turned off when the voltage level of the switching signal is a second voltage level, and, in a second time period of the divided different time periods, the switching transistor may be turned on when a voltage level of the switching signal is more than a voltage level obtained by adding the threshold voltage level to the second voltage level and may be turned off when the voltage level of the switching signal is a third voltage level.

The pixel device may further include a buffer transistor connected in series between a source electrode of the switching transistor and the storage capacitor, wherein, in the first time period, a voltage that is more than the voltage level obtained by adding the threshold voltage level to the first voltage level is applied to a gate terminal of the buffer transistor, and, in the second time period, a voltage that is more than the voltage level obtained by adding the threshold voltage level to the second voltage level is applied to the gate terminal of the buffer transistor.

BRIEF DESCRIPTION OF THE DRAWINGS

These and/or other aspects will become apparent and more readily appreciated from the following description of the example embodiments, taken in conjunction with the accompanying drawings in which:

FIGS. 3A through 6C are timing diagrams for explaining an operation of the reflective display device of FIG. 1;

DETAILED DESCRIPTION

Figure 1:
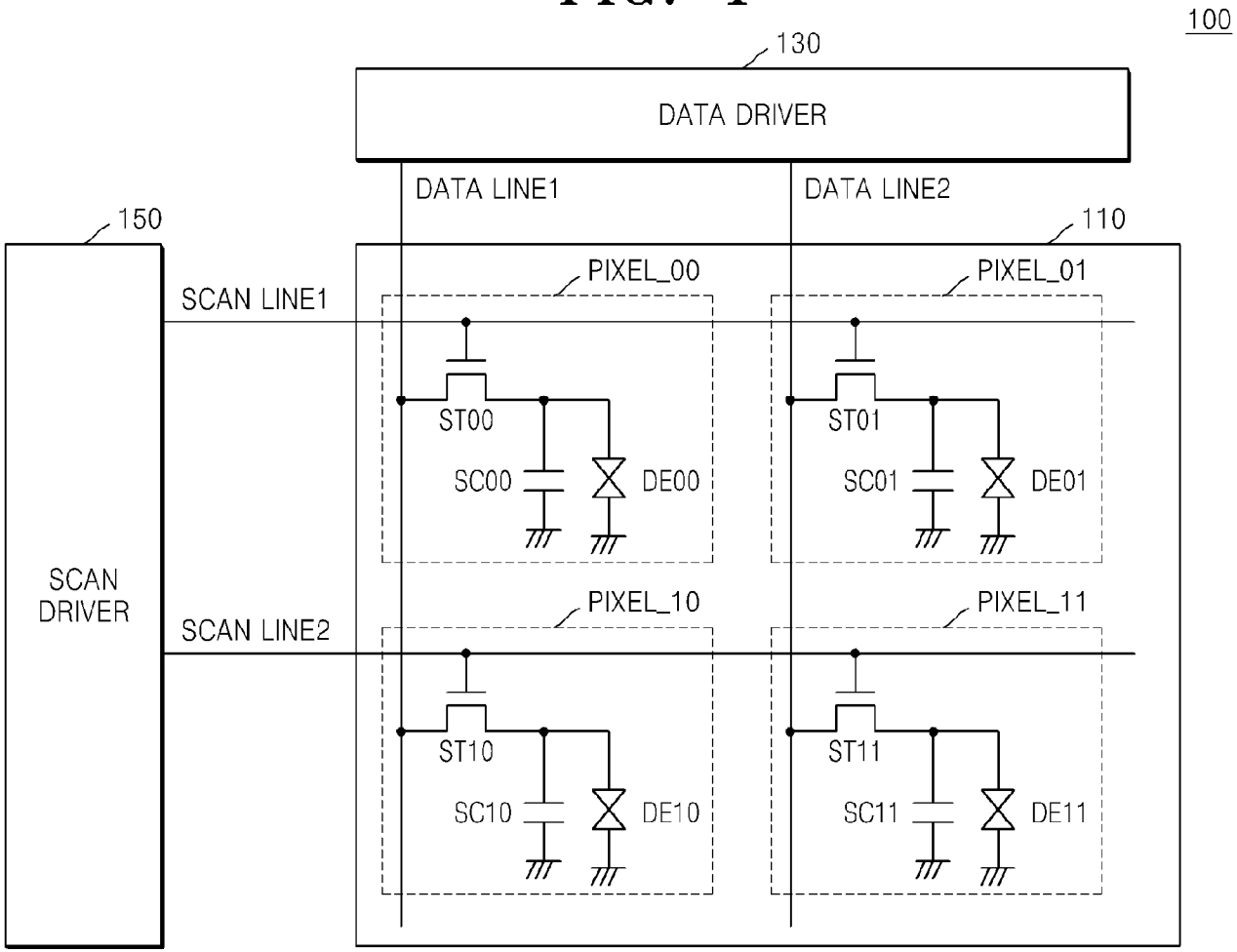
FIG. 1 is a diagram illustrating a reflective display device according to an example embodiment.

The present invention will now be described more fully with reference to the accompanying drawings, in which example embodiments are shown. The present invention may, however, be embodied in many different forms and should not be construed as being limited to the example embodiments set forth herein; rather, these example embodiments are provided so that this disclosure will be thorough and complete, and will fully convey the present invention to those of ordinary skill in the art.

The terminology used herein is for the purpose of describing example embodiments only and is not intended to be limiting of the example embodiments. As used herein, the singular forms "a", "an", and "the" are intended to include the plural forms as well, unless the context clearly indicates otherwise. It will be further understood that the terms "includes," "including," "comprises" and/or "comprising" when used in this specification specify the presence of stated features, integers, steps, operations, elements, and/or components, but do not preclude the presence or addition of one or more other features, integers, steps, operations, elements, components, and/or groups thereof. As used herein, the terminology "and/or" includes any and all combinations of one or more listed items.

It will be understood that, although the terms first, second, third, etc., may be used herein to describe various elements, components, regions, and/or sections, these elements, components, regions, and/or sections should not be limited by these terms. These terms do not signify specific sequences, top and bottom, or merits and demerits, and are only used to distinguish one element, component, region, or section from another element, component, region, or section. Thus, a first element, component, region, or section discussed below could be termed a second element, component, region, or section without departing from the teachings of the example embodiments.

It will be understood that the shapes of elements illustrated in the drawings may vary, for example, according to manufacturing technologies and/or tolerances. Therefore, the example embodiments should not be construed as being limited to specific figures illustrated in the drawings and should include changes of figures caused by manufacturing. Like reference numerals and like symbols refer to like elements throughout. Furthermore, in the drawings, sizes of elements or regions may be exaggerated for clarity. Therefore, the present invention is not limited by relative sizes or intervals drawn in the drawings.

FIG. 1 illustrates a reflective display device 100 according to an example embodiment.

Referring to FIG. 1, the reflective display device 100 may include a pixel array 110, a data driver 130, and a scan driver 150.

The pixel array 110 includes a plurality of pixels PIXEL_00, PIXEL_01, PIXEL_10, and PIXEL_11. However, the number of pixels is just an example, the number of pixels may vary and example embodiments are not limited thereto. For example, the number of pixels may be a hundred thousand multiplied by a hundred thousand.

The plurality of pixels PIXEL_00, PIXEL_01, PIXEL_10, and PIXEL_11 may include switching transistors ST00, ST01, ST10, and ST11 respectively, storage capacitors SC00, SC01, SC10, and SC11 respectively, and display elements DE00, DE01, DE10, and DE11 respectively.

Gate terminals of the switching transistors ST00, ST01, ST10, and ST11 are connected to a scan line SCAN LINE1 or SCAN LINE2 connected to the scan driver 150. Drain terminals of the switching transistors ST00, ST01, ST10, and ST11 are connected to a data line DATA LINE1 or DATA LINE2. Source terminals of the switching transistors ST00, ST01, ST10, and ST11 are connected to the storage capacitors SC00, SC01, SC10, and SC11, respectively, and to the display elements DE00, DE01, DE10, and DE11, respectively. The storage capacitors SC00, SC01, SC10, and SC11 are connected in parallel to the display elements DE00, DE01, DE10, and DE11, respectively.

The switching transistors ST00, ST01, ST10, and ST11 may determine whether or not to transmit data, which is transmitted from the data driver 130, to the display elements DE00, DE01, DE10, and DE11, respectively. For example, for each time period, the switching transistors ST00, ST01, ST10, and ST11 may toggle from an "on" state to an "off" state or from the "off" state to the "on" state. During "on" states of the switching transistors ST00, ST01, ST10, and, ST11, data information of the data lines DATA LINE1 and DATA LINE2 may be transmitted to the display elements DE00, DE01, DE10, and DE11.

The storage capacitors SC00, SC01, SC10, and SC11 may buffer voltages that are transmitted to the display elements DE00, DE01, DE10, and DE11, respectively. For example, the storage capacitors SC00, SC01, SC10, and SC11 are connected to the display elements DE00, DE01, DE10, and DE11 in parallel, respectively, and thus, a voltage difference between both ends of each of the storage capacitors SC00, SC01, SC10, and SC11 becomes the same as that between both ends of each of the display elements DE00, DE01, DE10, and DE11.

The display elements DE00, DE01, DE10, and DE11 may reflect data information and then display reflected data. The data information may be transmitted to the display elements DE00, DE01, DE10, and DE11 in a form of a voltage level. For example, the voltage level may indicate light and darkness, that is, contrast, of an image.

The display elements DE00, DE01, DE10, and DE11 may be initially set with a maximum voltage or a minimum voltage of the data information. For example, if the maximum voltage of the data information is 40 volts (V), all the display elements DE00, DE01, DE10, and DE11 may be previously set with 40 V which is the maximum voltage or 0 V which is the minimum voltage.

The display elements DE00, DE01, DE10, and DE11 may be initially set with a voltage between the maximum voltage of the data information and the minimum voltage of the data information. For example, if the maximum voltage of the data information is 40 V, the display elements DE00, DE01, DE10, and DE11 may be previously set with a voltage between 40 V and 0 V, which is the minimum voltage.

The data driver 130 is connected to the plurality of data lines DATA LINE1 and DATA LINE2 and supplies voltages depending on data information to be stored in the display elements DE00, DE01, DE10, and DE11 to the drain terminals of the switching transistors ST00, ST01, ST10, and ST11. The number of data lines is just an example, the number of data lines may vary and example embodiments are not limited thereto. In addition, the maximum voltage of the data information may vary. For example, the maximum voltage of the data information may be 40 V, 20 V, or 10 V. If the maximum voltage of the data information is 40 V, the data information may be 40 V, 30 V, 10 V, and 0 V. The data information may be transmitted to the display elements DE00, DE01, DE10, and DE11 and then indicate contrast in the display elements DE00, DE01, DE10, and DE11.

The scan driver 150 is connected to the plurality of scan lines SCAN LINE1 and SCAN LINE2 and turns on or off the switching transistors ST00, ST01, ST10, and ST11. The scan driver 150 is turned on once during a first time period and turned on once during a second time period. The scan driver 150 is changed from the "off" state to the "on" state during the first time period and then changed from the "on" state to the "off" state. In addition, the scan driver 150 is changed from the "off" state to the "on" state during the second time period and then changed from the "on" state to the "off" state. For example, if the maximum voltage of the data information is 40 V, during the first time period, the scan driver 150 may turn off the switching transistors ST00, ST01, ST10, and ST11 by applying 20 V to the scan lines SCAN LINE1 and SCAN LINE2 and may turn on the switching transistors ST00, ST01, ST10, and ST11 by applying a voltage that is more than a voltage 40+VT obtained by adding 40 V and a threshold voltage VT of the switching transistors ST00, ST01, ST10, and ST11 to the scan lines SCAN LINE1 and SCAN LINE2. In addition, during the second time period, the scan driver 150 may turn off the switching transistors ST00, ST01, ST10, and ST11 by applying 0 V to the scan lines SCAN LINE1 and SCAN LINE2 and may turn on the switching transistors ST00, ST01, ST10, and ST11 by applying a voltage that is more than a voltage 20 V+VT obtained by adding 20 V and the threshold voltage VT to the scan lines SCAN LINE1 and SCAN LINE2.

Hereinafter, an operation of the reflective display device 100 is described.

Figure 2:
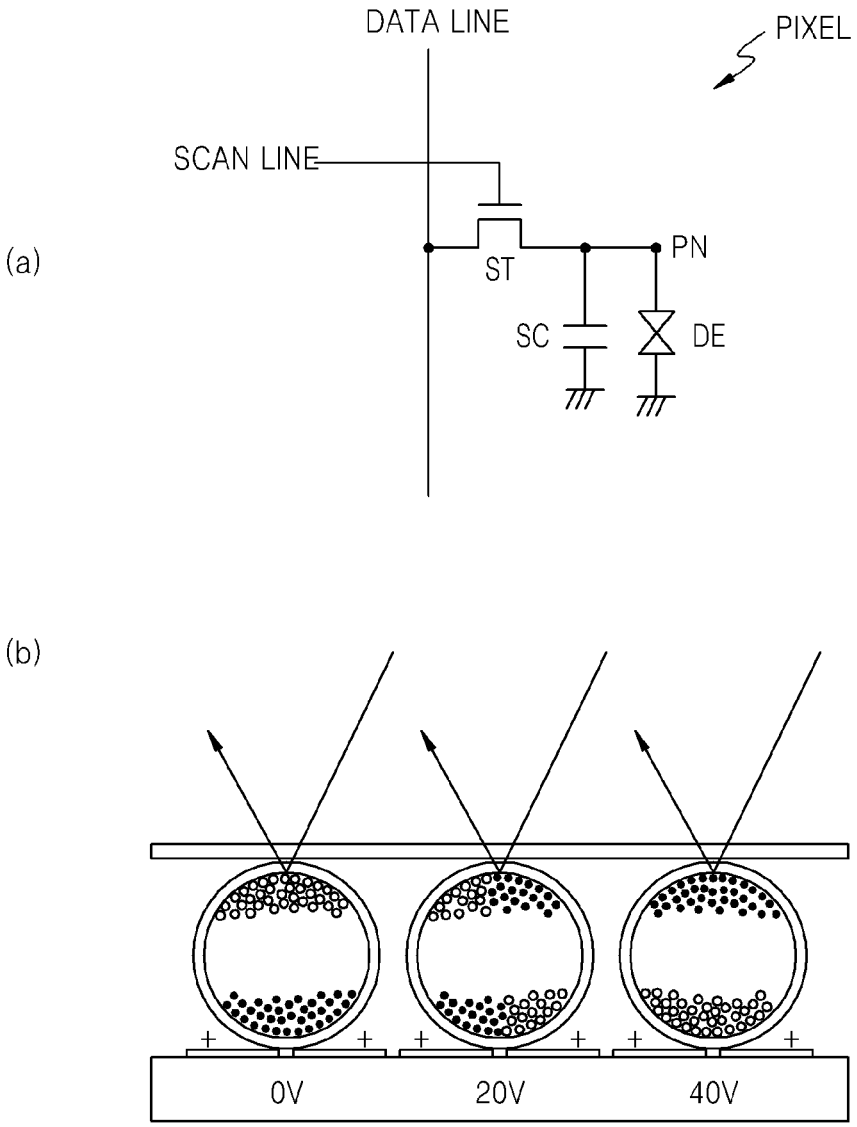
FIG. 2A is a circuit diagram illustrating a pixel included in the reflective display device of FIG. 1.
FIG. 2B is a diagram illustrating a pixel included in the reflective display device of FIG. 1, according to data information.
Figure 3:
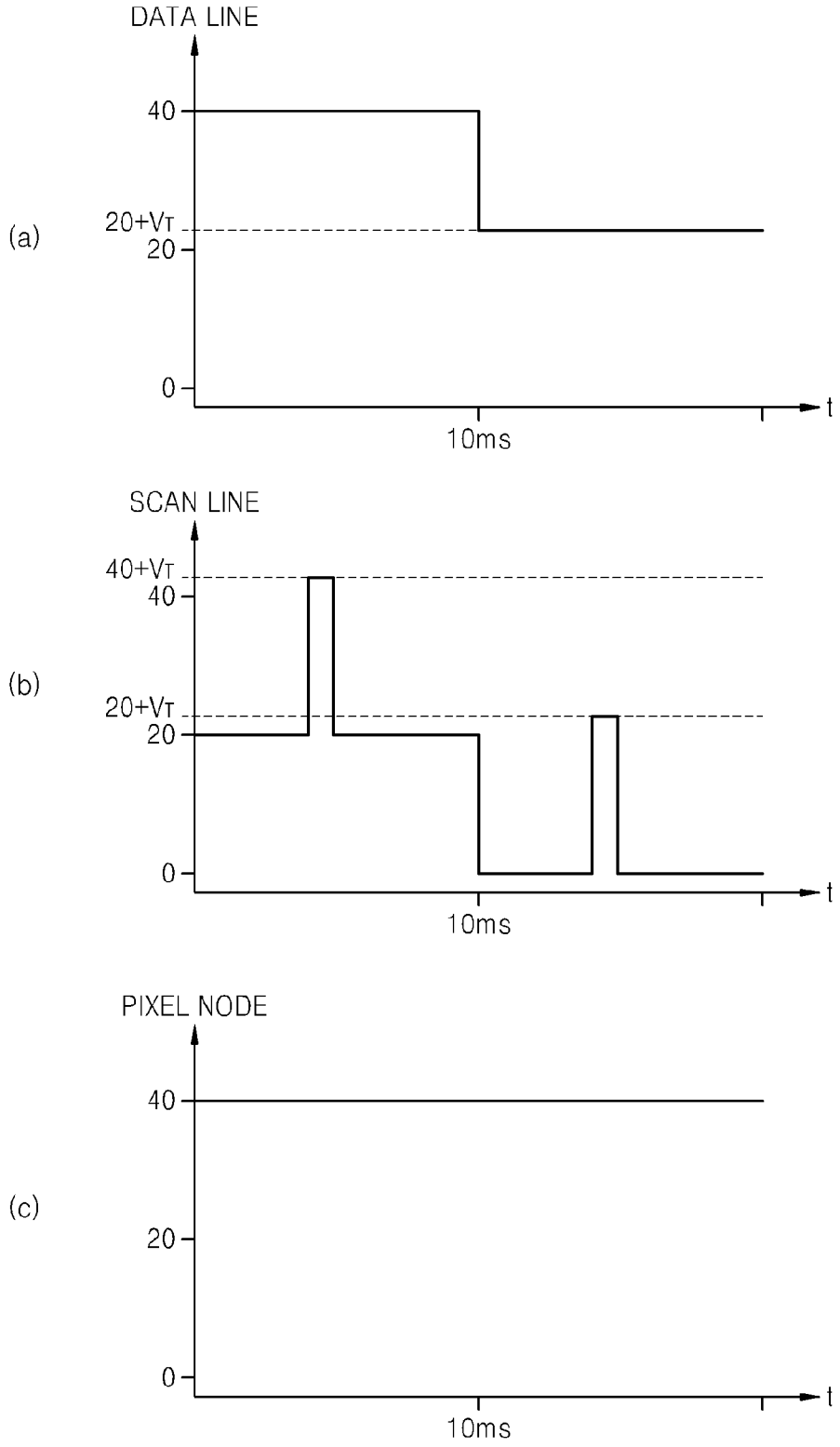
Figure 4:
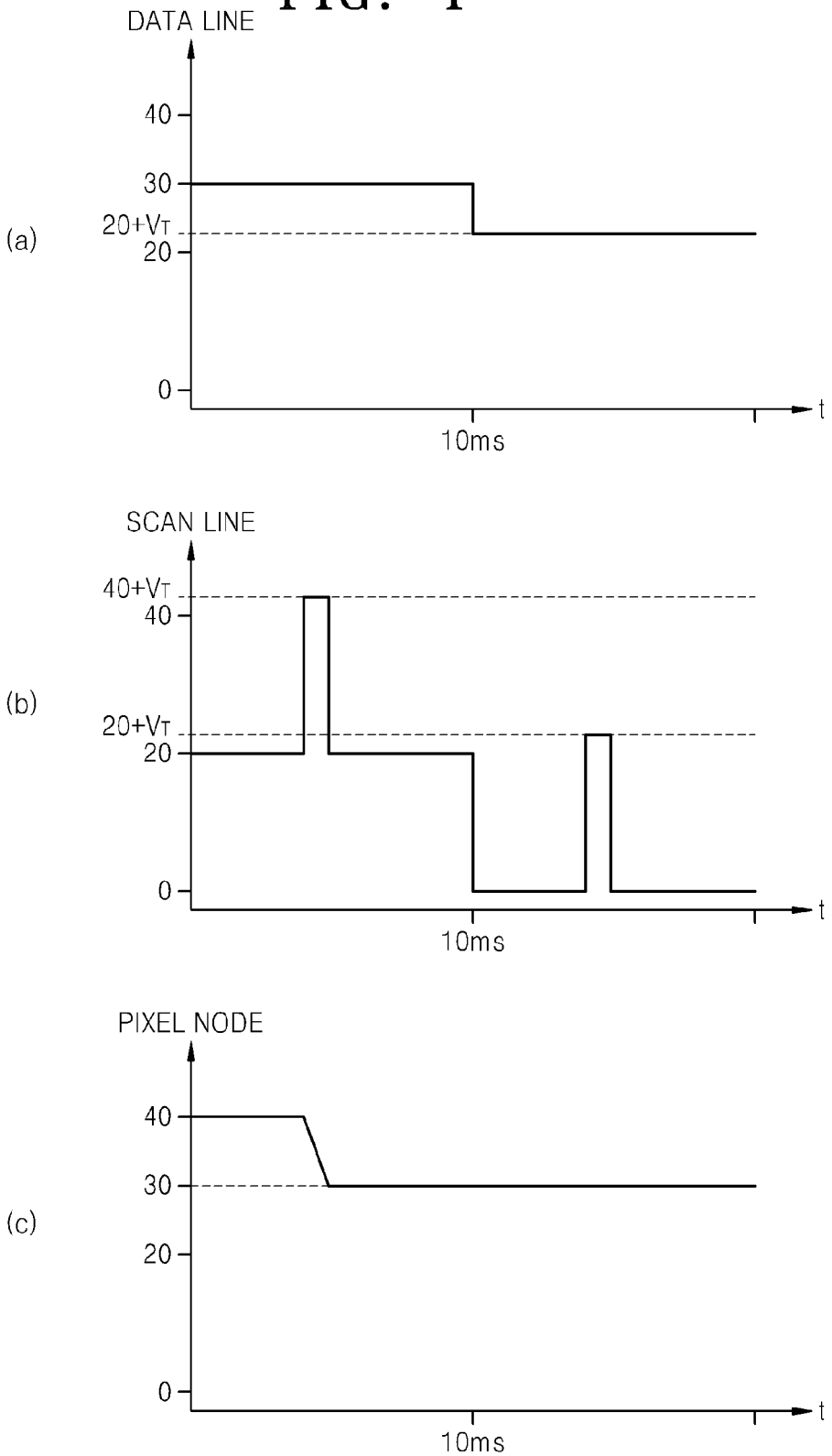
Figure 5:
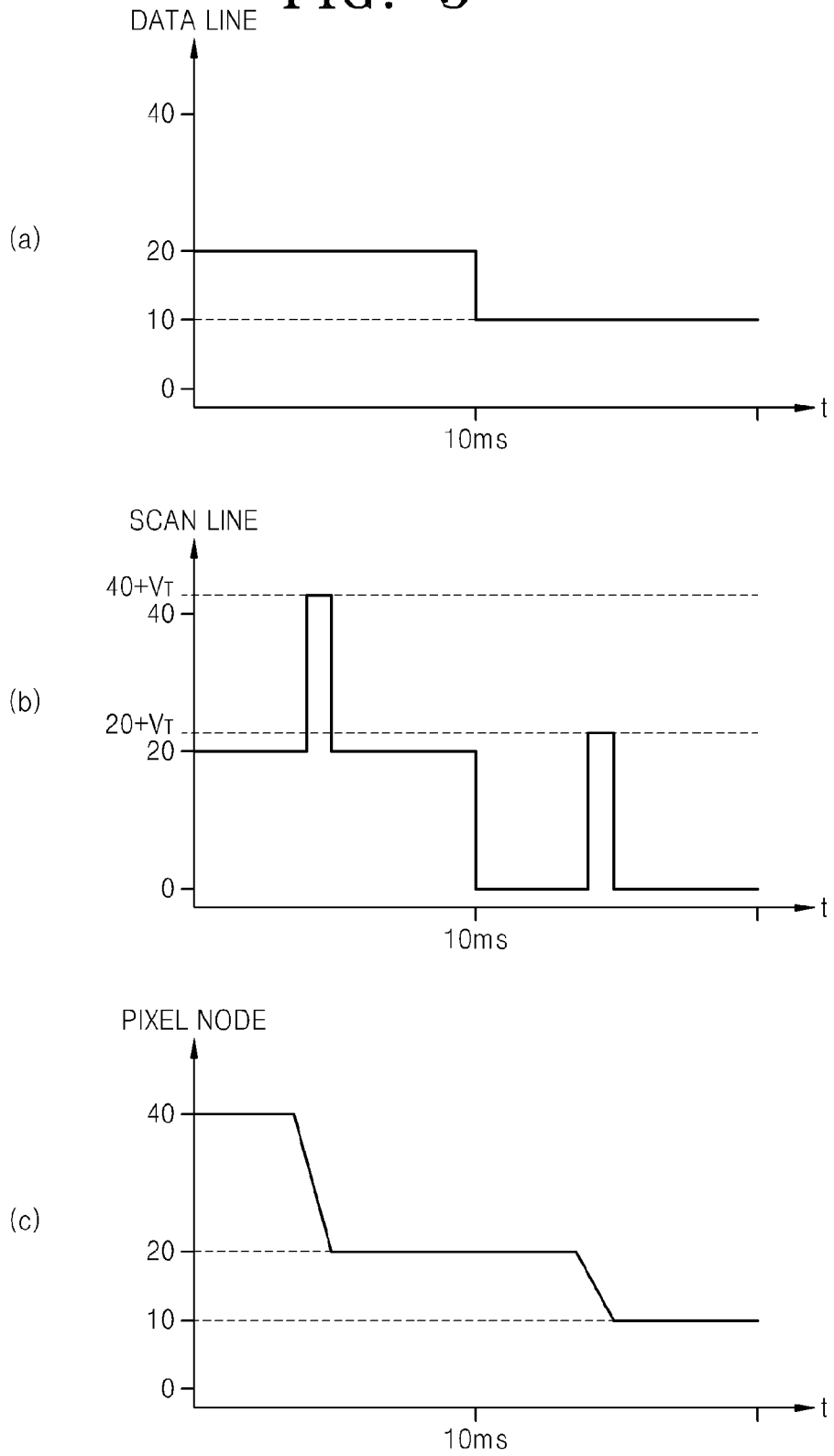
Figure 6:
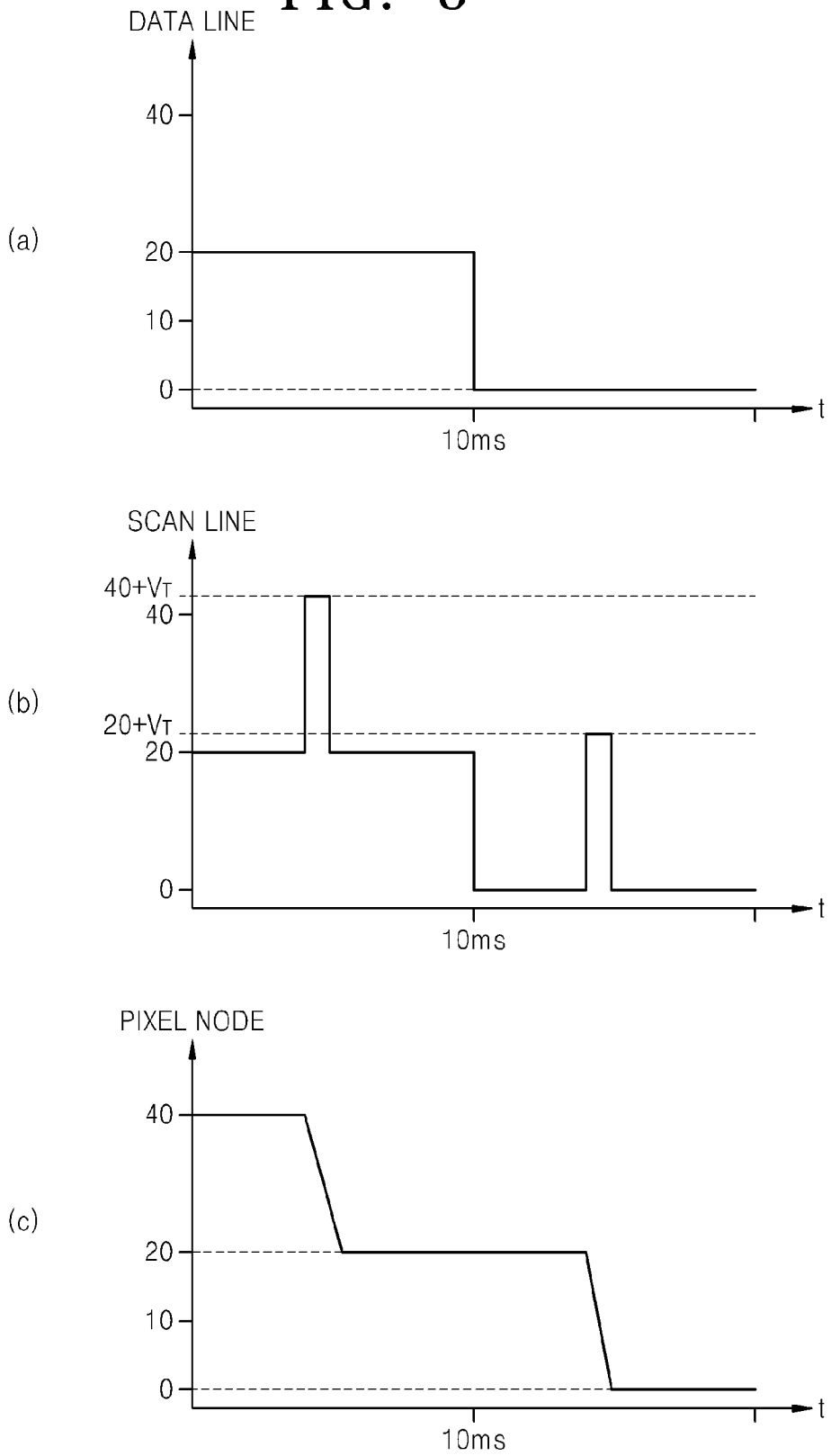

FIG. 2A is a circuit diagram of a pixel included in the reflective display device 100, and FIG. 2B is a diagram illustrating a pixel included in the reflective display device 100 according to data information.

Referring to FIG. 2A, each pixel included in the reflective display device 100 may include a switching transistor ST, a storage capacitor SC, and a display element DE. A voltage level of a pixel node PN to which a source terminal of the switching transistor ST, the storage capacitor SC, and the display element DE are commonly connected may indicate a voltage level of the display elements DE. The voltage level of the display element DE may indicate information that is displayed.

As illustrated above, a diagram illustrating a pixel included in the reflective display device 100 according to data information is illustrated in FIG. 2B. A display method of the pixel depending on the voltage level of the pixel node PN is described with reference to FIGS. 2A and 2B. The display element DE includes a liquid crystal for displaying black and a liquid crystal for displaying white. In this case, the liquid crystal for displaying black is charged with negative charges, and the liquid crystal for displaying white is charged with positive charges. Gray may be displayed when the liquid crystal for displaying black is mixed with the liquid crystal for displaying white. In addition, light and darkness, that is, contrast, of the gray may be adjusted depending on a ratio in which the liquid crystal for displaying black is mixed with the liquid crystal for displaying white.

FIGS. 3A through 6C are timing diagrams for explaining an operation of the reflective display device 100.

FIGS. 3A through 3C illustrate voltage levels of the data line DATA LINE, the scan line SCAN LINE, and the pixel node PN, respectively, for the first and second time periods when the maximum voltage of the data information is 40 V and a target voltage applied to the display element DE is 40 V. However, the maximum voltage 40 V is just an example, the maximum voltage may vary and example embodiments are not limited thereto. For example, the maximum voltage may be 20 V, 5 V, or the like. The target voltage is stored in the storage capacitor SC. The display element DE displays data information by reflecting a voltage level of the target voltage stored in the storage capacitor SC.

Referring to FIGS. 2A and 3A through 3C, the voltage of the pixel node PN may be previously set at 40 V, which is the maximum voltage of the data information, before the first time period. In another example embodiment, the voltage of the pixel node PN may be set at 0 V, which is the minimum voltage of the data information, before the first time period. In another example embodiment, the voltage of the pixel node PN may be set at a voltage between 40 V, which is the maximum voltage of the data information, and 0 V, which is the minimum voltage of the data information, before the first time period.

If the voltage of the pixel node PN is previously set at 40 V, which is the maximum voltage of the data information, 40 V is initially applied to the data line DATA LINE in the first time period since the target voltage is 40 V. In order for the switching transistor ST to be turned on, a voltage that is higher than a voltage of the data line DATA LINE by the threshold voltage of the switching transistor ST needs to be applied to the gate terminal of the switching transistor ST. In a portion of the first time period, a second voltage level 40 V+VT, obtained by adding 40 V and the threshold voltage VT of the switching transistor ST, may be applied to the scan line SCAN LINE, the gate terminal of the switching transistor ST, to turn on the switching transistor ST. In this case, in the portion of the first time period, the voltage of the pixel node PN to which the storage capacitor SC and the display element DE are commonly connected becomes equal to the voltage of the data line DATA LINE. However, since both the target voltage and the previously set voltage of the pixel node PN are 40 V, the voltage level of the pixel node PN does not vary. That is, the voltage level of the pixel node PN is maintained at 40 V.

In the second time period, a voltage 20 V+VT obtained by adding 20 V to the threshold voltage VT is applied to the data line DATA LINE. In another example embodiment, a voltage that is over 20 V and under 40 V may be applied to the data line DATA LINE to turn off the switching transistor ST. In the second time period, a first voltage level 0 V for turning off the switching transistor ST or a second voltage level 20 V+VT for turning on the switching transistor ST may be applied to the scan line SCAN LINE. At this time, since 20 V+VT is applied to the data line DATA LINE, a voltage of the gate terminal of the switching transistor ST becomes lower than a voltage between the drain terminal of the switching transistor ST and the source terminal thereof, and thus, the switching transistor ST may be turned off. In this case, in the second time period, a voltage of one end of the capacitor SC and a voltage of one end of the display element DE are maintained with 40 V independent of a voltage of the data line DATA LINE. Also, 40 V applied to the pixel node PN is maintained independent of the voltage of the data line DATA LINE. Thus, in the pixel circuit included in the reflective display device 100 according to the example embodiment, a voltage difference between the gate terminal of the switching transistor ST and the drain terminal thereof may be about half a voltage difference between the gate terminal and the drain terminal when a voltage of the data line DATA LINE fully swings from 0 V to 40 V. Thus, a possibility of degradation of an oxide film of the switching transistor ST may be lowered.

FIGS. 4A through 4C illustrate voltage levels of the data line DATA LINE, the scan line SCAN LINE, and the pixel node PN, respectively, for the first and second time periods when the maximum voltage of the data information is 40 V and a target voltage applied to the display element DE is 30 V. Similar to the case of FIGS. 3A through 3C, the maximum voltage 40 V is just an example, the maximum voltage may vary and example embodiments are not limited thereto.

Referring to FIGS. 2A and 4A through 4C, the voltage of the pixel node PN may be previously set at 40 V, which is the maximum voltage of the data information, before the first time period. In another example embodiment, the voltage of the pixel node PN may be set at 0 V, which is the minimum voltage of the data information, before the first time period. In another example embodiment, the voltage of the pixel node PN may be set at a voltage between 40 V, which is the maximum voltage of the data information, and 0 V, which is the minimum voltage of the data information, before the first time period.

If the voltage of the pixel node PN is previously set at 40 V, which is the maximum voltage of the data information, 30 V is initially applied to the data line DATA LINE in the first time period since the target voltage of 30 V is between the maximum voltage and a medium voltage. In order for the switching transistor ST to be turned on, a voltage that is higher than a voltage of the data line DATA LINE by the threshold voltage of the switching transistor ST needs to be applied to the gate terminal of the switching transistor ST. In a portion of the first time period, a voltage level 40 V+VT, obtained by adding 40 V to the threshold voltage VT of the switching transistor ST, may be applied to the scan line SCAN LINE to turn on the switching transistor ST. In this case, in the portion of the first time period, the voltage of the pixel node PN to which the storage capacitor SC and the display element DE are commonly connected becomes equal to the voltage of the data line DATA LINE. However, since the voltage of the data line DATA LINE is 30 V, the voltage level of the pixel node PN is changed from 40 V to 30 V.

In the second time period, a voltage 20 V+VT, obtained by adding 20 V to the threshold voltage VT, is applied to the data line DATA LINE. In another example embodiment, a voltage that is over 20 V and under 40 V may be applied to the data line DATA LINE to turn off the switching transistor ST. In the second time period, a first voltage level 0 V for turning off the switching transistor ST or a second voltage level 20 V+VT for turning on the switching transistor ST is applied to the scan line SCAN LINE. At this time, since 20 V+VT is applied to the data line DATA LINE, the switching transistor ST maintains an "off" state although the second voltage level 20 V+VT is applied to the scan line SCAN LINE. Thus, in the second time period, a voltage of one end of the capacitor SC and a voltage of one end of the display element DE are maintained at the 30 V set during the first time period. That is, 30 V applied to the pixel node PN is maintained independent of the voltage of the data line DATA LINE. Thus, in the pixel circuit included in the reflective display device 100 according to the example embodiment, a voltage difference between the gate terminal of the switching transistor ST and the drain terminal thereof may be small compared to a voltage difference between the gate terminal and the drain terminal when a voltage of the data line DATA LINE is continuously maintained at 40 V. Thus, a possibility of degradation of an oxide film of the switching transistor ST may be lowered.

FIGS. 5A through 5C illustrate voltage levels of the data line DATA LINE, the scan line SCAN LINE, and the pixel node PN, respectively, for the first and second time periods when the maximum voltage of the data information is 40 V and a target voltage applied to the display element DE is 10 V. Similar to the case of FIGS. 3A through 3C, the maximum voltage 40 is just an example, the maximum voltage may vary and example embodiments are not limited thereto.

Referring to FIGS. 2A and 5A through 5C, the voltage of the pixel node PN may be previously set at 40 V, which is the maximum voltage of the data information, before the first time period. In another example embodiment, the voltage of the pixel node PN may be set at 0 V, which is the minimum voltage of the data information, before the first time period. In another example embodiment, the voltage of the pixel node PN may be set at a voltage between 40 V, which is the maximum voltage of the data information, and 0 V, which is the minimum voltage of the data information, before the first time period.

If the voltage of the pixel node PN is previously set at 40 V, which is the maximum voltage of the data information, a medium voltage 20 V is initially applied to the data line DATA LINE in the first time period since the target voltage is 10 V, between the medium voltage and the minimum voltage. In order for the switching transistor ST to be turned on, a voltage that is higher than a voltage of the data line DATA LINE by the threshold voltage of the switching transistor ST needs to be applied to the gate terminal of the switching transistor ST. In a portion of the first time period, a voltage level of the scan line SCAN LINE may be increased from 20 V to 40 V+VT, obtained by adding 40 V and the threshold voltage VT of the switching transistor ST, to turn on the switching transistor ST. In this case, in the portion of the first time period, the voltage of the pixel node PN to which the storage capacitor SC and the display element DE are commonly connected becomes equal to the voltage of the data line DATA LINE. However, since the voltage of the data line DATA LINE is 20 V, the voltage level of the pixel node PN is changed from 40 V to 20 V.

In the second time period, the target voltage 10 V is applied to the data line DATA LINE. As stated above, in order for the switching transistor ST to be turned on, a voltage that is higher than a voltage of the data line DATA LINE by the threshold voltage of the switching transistor ST needs to be applied to the gate terminal of the switching transistor ST. In the second time period, a first voltage level 0 V for turning off the switching transistor ST or a second voltage level 20 V+VT for turning on the switching transistor ST is applied to the scan line SCAN LINE. In this case, in a portion of the second time period, that is, while the second voltage level 20 V+VT is being applied to the scan line SCAN LINE, the voltage of the pixel node PN to which the storage capacitor SC and the display element DE are commonly connected becomes equal to the voltage of the data line DATA LINE. That is, the voltage level of the pixel node PN is changed from 20 V to 10 V since the voltage level of the data line DATA LINE is 10 V.

Thus, in the pixel circuit included in the reflective display device 100 according to the example embodiment, a voltage difference between the gate terminal of the switching transistor ST and the drain terminal thereof may be small compared to a voltage difference between the gate terminal and the drain terminal when a voltage of the data line DATA LINE fully swings from 0 V to 40 V. Thus, a possibility of degradation of an oxide film of the switching transistor ST may be lowered.

FIGS. 6A through 6C illustrate voltage levels of the data line DATA LINE, the scan line SCAN LINE, and the pixel node PN, respectively, for the first and second time periods when the maximum voltage of the data information is 40 V and a target voltage applied to the display element DE is 0 V. Similar to the case of FIGS. 3A through 3C, the maximum voltage 40 is just an example, the maximum voltage may vary and example embodiments are not limited thereto.

Referring to FIGS. 2A and 6A through 6C, the voltage of the pixel node PN may be previously set at 40 V, which is the maximum voltage of the data information, before the first time period. In another example embodiment, the voltage of the pixel node PN may be set at 0 V, which is the minimum voltage of the data information, before the first time period. In another example embodiment, the voltage of the pixel node PN may be set at a voltage between 40 V, which is the maximum voltage of the data information, and 0 V, which is the minimum voltage of the data information, before the first time period.

If the voltage of the pixel node PN is previously set at 40 V, which is the maximum voltage of the data information, a medium voltage 20 V is initially applied to the data line DATA LINE in the first time period since the target voltage is 0 V, which is the minimum voltage. In order for the switching transistor ST to be turned on, a voltage that is higher than a voltage of the data line DATA LINE by the threshold voltage of the switching transistor ST needs to be applied to the gate terminal of the switching transistor ST. In a portion of the first time period, a voltage level of the scan line SCAN LINE may be increased from 20 V to 40 V+VT, obtained by adding 40 V and the threshold voltage VT of the switching transistor ST, to turn on the switching transistor ST. In this case, in the portion of the first time period, the voltage of the pixel node PN to which the storage capacitor SC and the display element DE are commonly connected becomes equal to the voltage of the data line DATA LINE. However, since the voltage of the data line DATA LINE is 20 V, the voltage level of the pixel node PN is changed from 40 V to 20 V.

In the second time period, the target voltage 0 V is applied to the data line DATA LINE. As stated above, in order for the switching transistor ST to be turned on, a voltage that is higher than a voltage of the data line DATA LINE by the threshold voltage of the switching transistor ST needs to be applied to the gate terminal of the switching transistor ST. In a portion of the second time period, a voltage level of the scan line SCAN LINE may be increased from 0 V to 20 V+VT to turn on the switching transistor ST. In this case, in the portion of the second time period, the voltage of the pixel node PN to which the storage capacitor SC and the display element DE are commonly connected becomes equal to the voltage of the data line DATA LINE. That is, the voltage level of the pixel node PN is changed from 20 V to 0 V since the voltage level of the data line DATA LINE is 0 V.

Thus, in the pixel circuit included in the reflective display device 100 according to the example embodiment, a voltage difference between the gate terminal of the switching transistor ST and the drain terminal thereof may be small compared to a voltage difference between the gate terminal and the drain terminal when a voltage of the data line DATA LINE is continuously maintained at 40 V. Thus, a possibility of degradation of an oxide film of the switching transistor ST may be lowered.

Figure 7:
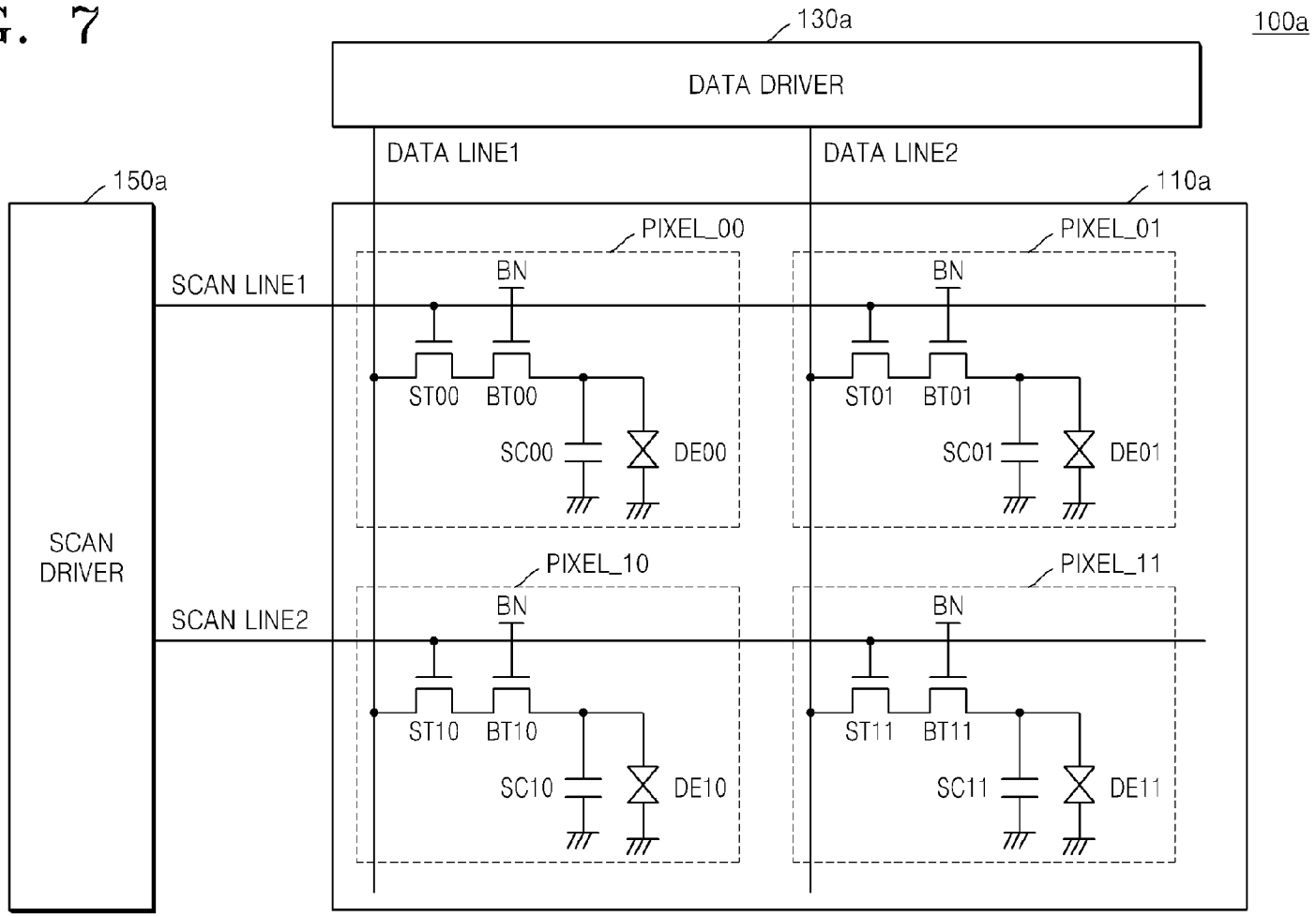
FIG. 7 is a diagram illustrating a reflective display device according to another example embodiment.

FIG. 7 illustrates a reflective display device 100A according to another example embodiment.

Referring to FIG. 7, the reflective display device 100A may include a pixel array 110A, a data driver 130A, and a scan driver 150A.

The pixel array 110A includes a plurality of pixels PIXEL_00, PIXEL_01, PIXEL_10, and PIXEL_11. Similar to the case of FIG. 1, the number of pixels is just an example, the number of pixels may vary and example embodiments are not limited thereto. For example, the number of pixels may be a hundred thousand multiplied by a hundred thousand.

The plurality of pixels PIXEL_00, PIXEL_01, PIXEL_10, and PIXEL_11 may include switching transistors ST00, ST01, ST10, and ST11 respectively, storage capacitors SC00, SC01, SC10, and SC11 respectively, and display elements DE00, DE01, DE10, and DE11 respectively. In the current example embodiment, the plurality of pixels PIXEL_00, PIXEL_01, PIXEL_10, and PIXEL_11 may further include buffer transistors BT00, BT01, BT10, and BT11, respectively. The switching transistors ST00, ST01, ST10, and ST11, the storage capacitors SC00, SC01, SC10, and SC11, and the display elements DE00, DE01, DE10, and DE11 operate similar to those of FIG. 1.

Gate terminals of the switching transistors ST00, ST01, ST10, and ST11 are connected to a scan line SCAN LINE1 or SCAN LINE2 connected to the scan driver 150. Drain terminals of the switching transistors ST00, ST01, ST10, and ST11 are connected to a data line DATA LINE1 or DATA LINE2. Source terminals of the switching transistors ST00, ST01, ST10, and ST11 are connected to the buffer transistors BT00, BT01, BT10, and BT11, respectively. Gate terminals of the buffer transistors BT00, BT01, BT10, and BT11 are connected to a buffer node BN. Drain terminals of the buffer transistors BT00, BT01, BT10, and BT11 are connected to the storage capacitors SC00, SC01, SC10, and SC11, respectively, and to the display elements DE00, DE01, DE10, and DE11, respectively. The storage capacitors SC00, SC01, SC10, and SC11 are connected in parallel to the display elements DE00, DE01, DE10, and DE11, respectively.

Next, an operation of the reflective display device 100A will be described.

Figure 8:
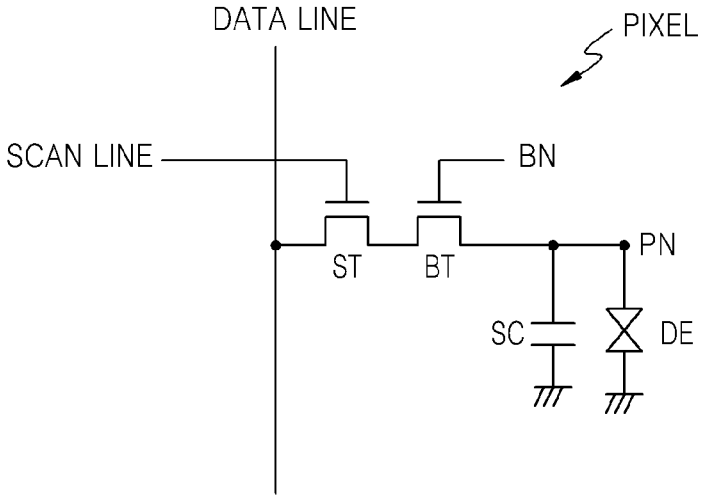
FIG. 8 is a circuit diagram of a pixel included in the reflective display device of FIG. 7.
Figure 9:
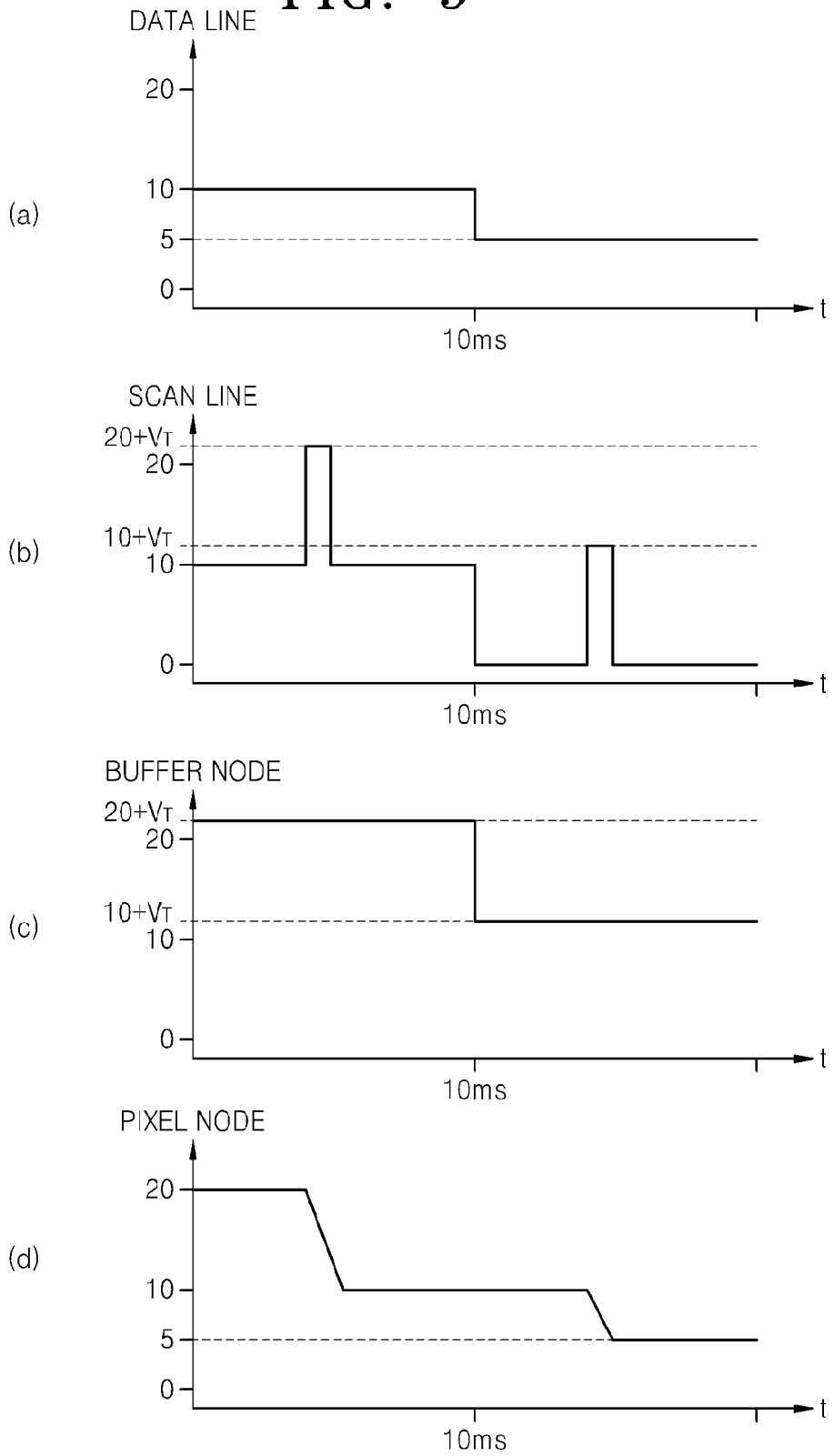
FIGS. 9A through 9D are timing diagrams for explaining an operation of the reflective display device of FIG. 7.

FIG. 8 is a circuit diagram of a pixel included in the reflective display device 100A.

Referring to FIG. 8, each pixel included in the reflective display device 100A may include a switching transistor ST, a buffer transistor BT, a storage capacitor SC, and a display element DE. In this case, a voltage level of a pixel node PN to which a source terminal of the buffer transistor BT, the storage capacitor SC, and the display element DE are commonly connected may indicate a voltage level of the display elements DE. The voltage level of the display element DE may indicate information that is displayed.

FIGS. 9A through 9D are timing diagrams for explaining an operation of the reflective display device 100A.

Referring to FIGS. 8 and 9A through 9D, the voltage of the pixel node PN may be previously set at 20 V, which is a maximum voltage of data information, before the first time period. If the voltage of the pixel node PN is previously set at 20 V, which is the maximum voltage of the data information, a medium voltage 10 V is initially applied to the data line DATA LINE in the first time period since a target voltage is 5 V, between the medium voltage and a minimum voltage. In order for the switching transistor ST to be turned on, a voltage that is higher than a voltage of the data line DATA LINE by the threshold voltage of the switching transistor ST needs to be applied to the gate terminal of the switching transistor ST. In a portion of the first time period, a voltage level of the scan line SCAN LINE may be increased from 10 V to 20 V+VT, obtained by adding 20 V and the threshold voltage VT of the switching transistor ST, to turn on the switching transistor ST. In this case, in the portion of the first time period, the voltage of the pixel node PN to which the storage capacitor SC and the display element DE are commonly connected becomes equal to the voltage of the data line DATA LINE. Since the voltage of the data line DATA LINE is 10 V, the voltage level of the pixel node PN is changed from 20 V to 10 V.

In the first time period, a voltage 20 V+VT is applied to the buffer node BN. Thus, since the buffer transistor BT is turned on during the first time period, data information of the data line DATA LINE may be transferred to the pixel node PN when the switching transistor ST is turned on. Since a gate terminal of a buffer transistor (not shown) of another pixel is also connected to the buffer node BN, the voltage 20 V+VT may be simultaneously applied to the gate terminals of the buffer transistor BT and the buffer transistor (not shown) of another pixel. By including the buffer transistor BT, a voltage difference between the source terminal of the switching transistor ST and the drain terminal thereof may be halved compared to a case where the pixel does not include the buffer transistor BT. A voltage difference between the data line DATA LINE and the pixel node PN is divided by the switching transistor ST and the buffer transistor BT. Thus, a leakage current is reduced.

In the second time period, the target voltage 5 V is applied to the data line DATA LINE. As stated above, in order for the switching transistor ST to be turned on, a voltage that is higher than a voltage of the data line DATA LINE by the threshold voltage of the switching transistor ST needs to be applied to the gate terminal of the switching transistor ST. In a portion of the second time period, a voltage level of the scan line SCAN LINE may be increased from 0 V to 10 V+VT, and thus, the switching transistor ST may be turned on. In this case, in the portion of the second time period, the voltage of the pixel node PN to which the storage capacitor SC and the display element DE are commonly connected becomes equal to the voltage of the data line DATA LINE. That is, the voltage level of the pixel node PN is changed from 10 V to 5 V since the voltage level of the data line DATA LINE is 5 V.

In the second time period, a voltage 10 V+VT is applied to the buffer node BN. Thus, since the buffer transistor BT is turned on during the second time period, data information of the data line DATA LINE may be transferred to the pixel node PN when the switching transistor ST is turned on. As stated above, since a gate terminal of a buffer transistor (not shown) of another pixel is also connected to the buffer node BN, the voltage 10 V+VT may be simultaneously applied to the gate terminals of the buffer transistor BT and the buffer transistor (not shown) of another pixel. By including the buffer transistor BT, a voltage difference between the source terminal of the switching transistor ST and the drain terminal thereof may be halved compared to a case where the pixel does not include the buffer transistor BT. A voltage difference between the data line DATA LINE and the pixel node PN is divided by the switching transistor ST and the buffer transistor BT. Thus, a leakage current is reduced.

Thus, in the pixel circuit included in the reflective display device 100A according to another example embodiment, a voltage difference between the gate terminal of the switching transistor ST and the drain terminal thereof may be small compared to a voltage difference between the gate terminal and the drain terminal when a voltage of the data line DATA LINE is continuously maintained at 20 V. As a result, a possibility of degradation of an oxide film of the switching transistor ST may be lowered. In addition, a leakage current is reduced since a voltage difference between the source terminal of the switching transistor ST and the drain terminal thereof is reduced.

Figure 10:
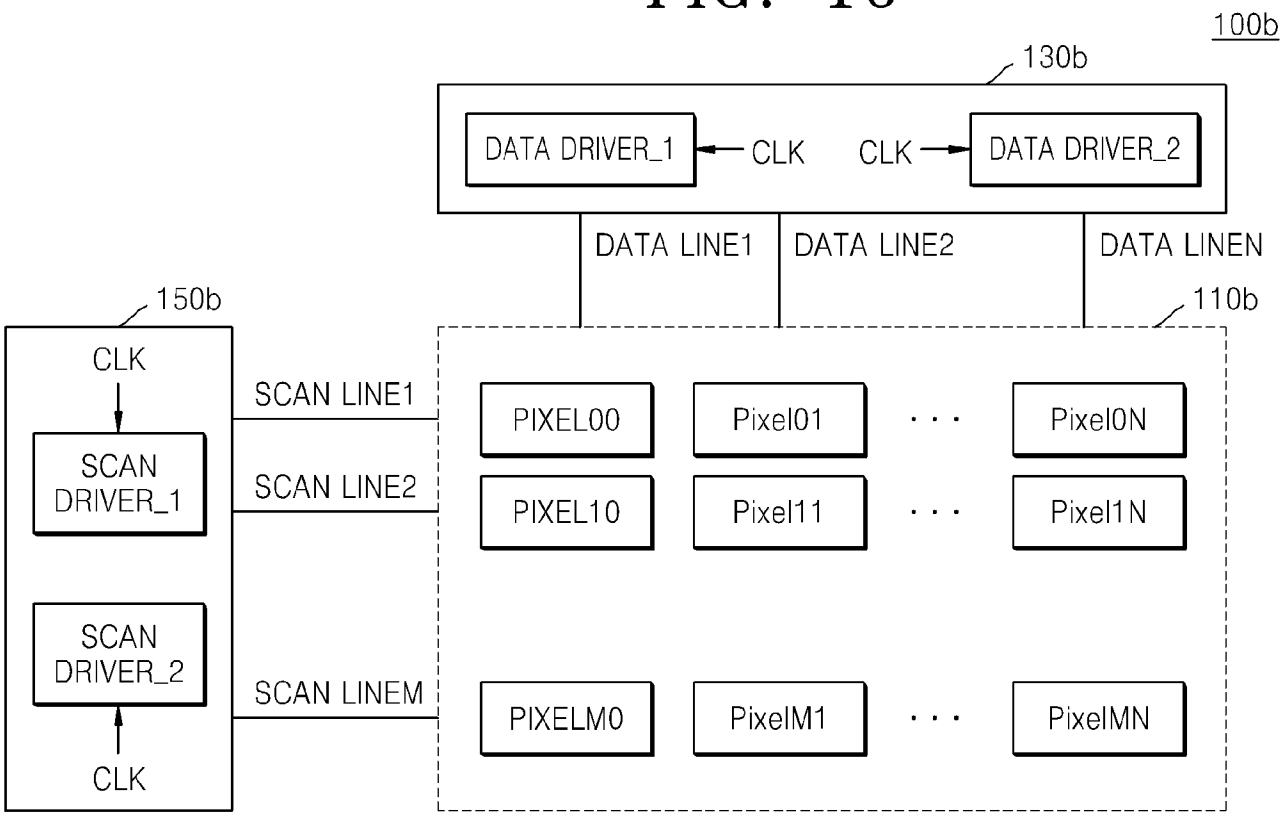
FIG. 10 is a block diagram illustrating a reflective display device according to another example embodiment.

FIG. 10 is a block diagram illustrating a reflective display device 100B according to another example embodiment.

Referring to FIG. 10, the reflective display device 100B may include a pixel array 110B, a data driver 130B, and a scan driver 150B.

The pixel array 110B includes a plurality of pixels PIXEL_00, PIXEL_01, PIXEL_10, PIXEL_11, and PIXEL_MN. The number of pixels is just an example, the number of pixels may vary and the present invention is not limited thereto. For example, the number of pixels may be a hundred thousand multiplied by a hundred thousand.

The data driver 130B may include a first data driver DATA DRIVER_1 and a second data driver DATA DRIVER_2. The first data driver DATA DRIVER_1 and the second data driver DATA DRIVER_2 may receive a clock signal CLK. The first data driver DATA DRIVER_1 may be active during a first time period to provide a voltage to a data line DATA LINE1. The second data driver DATA DRIVER_2 may be active during a second time period to provide a voltage to a data line DATA LINE2.

The scan driver 150B may include a first scan driver SCAN DRIVER_1 and a second scan driver SCAN DRIVER_2. The first scan driver SCAN DRIVER_1 and the second scan driver SCAN DRIVER_2 may receive the clock signal CLK. The first scan driver SCAN DRIVER_1 may be active during the first time period to provide a voltage to a scan line SCAN LINE1. The second scan driver SCAN DRIVER_1 may be active during the second time period to provide a voltage to a scan line SCAN LINE2. In another example embodiment, unlike the case of FIG. 10, only one scan driver and one data driver may be provided, and a power supply voltage (VDD) and a ground voltage (VSS) of the scan driver and the data driver may be changed during the first time period and the second time period to provide changed voltages to pixels.

While the present invention has been particularly shown and described with reference to example embodiments thereof, it will be understood that various changes in form and details may be made therein without departing from the spirit and scope of the following claims.

What is claimed is:

1. A reflective display device comprising:

a pixel array including a plurality of pixels;

a data driver connected to each of the plurality of pixels and configured to transmit a target voltage to each of the plurality of pixels; and a scan driver connected to each of the plurality of pixels and configured to transmit a switching signal for determining whether the data driver transmits the target voltage to some of the plurality of pixels, wherein, each of the plurality of pixels is configured to receive the target voltage for single data information from the data driver, receive the target voltage in a first time period when the target voltage that is transmitted to each of the plurality of pixels is between a first voltage level and a second voltage level, and receive the target voltage in a second time period when the target voltage is between the second voltage level and a third voltage level, and the scan driver is further configured to, transmit the switching signal having a first voltage value that is greater than the first voltage level during the first time period, and transmit the switching signal having a second voltage value that is greater than the second voltage value during the second time period.

2. The reflective display device of claim 1, wherein each of the plurality of pixels includes a switching transistor, the switching transistor includes a drain electrode connected to the data driver and a gate electrode connected to the scan driver, wherein, in the first time period, the switching transistor is configured to, turn on when a voltage level of the switching signal is more than a voltage level obtained by adding a threshold voltage level to the first voltage level, and turn off when the voltage level of the switching signal is the second voltage level, and in the second time period, the switching transistor is configured to, turn on when a voltage level of the switching signal is more than a voltage level obtained by adding the threshold voltage level to the second voltage level, and turn off when the voltage level of the switching signal is the third voltage level.

3. The reflective display device of claim 2, wherein each of the plurality of pixels further comprises:

a storage capacitor configured to store the target voltage; and a buffer transistor connected in series between a source electrode of the switching transistor and the storage capacitor, wherein, in the first time period, a voltage that is more than the voltage level obtained by adding the threshold voltage level to the first voltage level is applied to a gate terminal of the buffer transistor, and in the second time period, a voltage that is more than the voltage level obtained by adding the threshold voltage level to the second voltage level is applied to the gate terminal of the buffer transistor.

4. The reflective display device of claim 1, wherein, when the target voltage that is transmitted to each of the plurality of pixels is between the first voltage level and the second voltage level, a voltage level of the target voltage is applied to each pixel in the first time period, and a voltage of each pixel is maintained at the voltage level of the target voltage in the second time period.

5. The reflective display device of claim 1, wherein, when the target voltage that is transmitted to each of the plurality of pixels is between the second voltage level and the third voltage level, a fourth voltage level between the first voltage level and the second voltage level is applied to each pixel in the first time period, and a voltage level of the target voltage is applied to each pixel in the second time period.

6. The reflective display device of claim 5, wherein the fourth voltage level is an average of the first voltage level and the voltage level of the target voltage.

7. The reflective display device of claim 1, wherein each of the plurality of pixels is previously set at a voltage level between the first voltage level and the third voltage level before the first time period.

8. The reflective display device of claim 1, wherein the first voltage level is a maximum level of the target voltage, a minimum level of the target voltage, or an average of the maximum level and the minimum level.

9. The reflective display device of claim 1, wherein the data information includes contrast information.

10. A reflective display device comprising:

a pixel array including a plurality of pixels;

a data driver connected to each of the plurality of pixels and configured to transmit a target voltage to each of the plurality of pixels; and a scan driver connected to each of the plurality of pixels and configured to transmit a switching signal for determining whether the data driver transmits the target voltage to some of the plurality of pixels, wherein, each of the plurality of pixels is configured to, receive the target voltage for single data information from the data driver, and receive the target voltage in divided different time periods according to a voltage level range to which the target voltage belongs, and the scan driver is further configured to, transmit the switching signal having a first voltage value that is greater than the first voltage level during the first time period, and transmit the switching signal having a second voltage value that is greater than the second voltage value during the second time period.

11. The reflective display device of claim 10, wherein each of the plurality of pixels includes a switching transistor, the switching transistor includes a drain electrode connected to the data driver and a gate electrode connected to the scan driver, wherein the switching transistor is configured to, turn on or off in accordance with the switching signal, turn on in accordance with a voltage level of the switching signal, the voltage level varying depending on the divided different time periods, and turn off in accordance with a voltage level of the switching signal, the voltage level varying depending on the divided different time periods.

12. The reflective display device of claim 11, wherein each of the plurality of pixels further comprises:

a storage capacitor configured to store the target voltage; and a buffer transistor connected in series between a source electrode of the switching transistor and the storage capacitor, wherein the buffer transistor is turned on during all of the divided different time periods and a gate voltage of the buffer transistor varies depending on each of the divided different time periods.

13. The reflective display device of claim 10, wherein the data information includes contrast information.

14. A pixel device for a reflective display, the pixel device comprising:

a switching transistor including a drain electrode connected to a data driver and a gate electrode connected to a scan driver, the switching transistor configured to switch a target voltage, and the scan driver configured to, transmit a switching signal having a first voltage value that is greater than a first voltage level during a first time period, and transmit the switching signal having a second voltage value that is greater than a second voltage level during a second time period;

a storage capacitor connected to a source electrode of the switching transistor and configured to store the target voltage; and a display element connected in parallel to the storage capacitor and displays data corresponding to the target voltage;

wherein the storage capacitor receives the target voltage for single data information from the data driver and receives the target voltage in divided different time periods according to a voltage level range to which the target voltage belongs.

15. The pixel device of claim 14, wherein, in the first time period of the divided different time periods, the switching transistor is configured to, turn on when a voltage level of the switching signal is more than a voltage level obtained by adding a threshold voltage level to the first voltage level and turn off when the voltage level of the switching signal is the second voltage level, and in the second time period of the divided different time periods, the switching transistor is configured to, turn on when a voltage level of the switching signal is more than a voltage level obtained by adding the threshold voltage level to the second voltage level, and turn off when the voltage level of the switching signal is a third voltage level.

16. The pixel device of claim 15, further comprising a buffer transistor connected in series between a source electrode of the switching transistor and the storage capacitor, wherein, in the first time period, a voltage that is more than the voltage level obtained by adding the threshold voltage level to the first voltage level is applied to a gate terminal of the buffer transistor, and in the second time period, a voltage that is more than the voltage level obtained by adding the threshold voltage level to the second voltage level is applied to the gate terminal of the buffer transistor.

* * * * *